US007028962B1

(12) United States Patent
Hostetler

(10) Patent No.: US 7,028,962 B1
(45) Date of Patent: Apr. 18, 2006

(54) PORTABLE HOLDER FOR GAS CYLINDERS

(76) Inventor: Paul E. Hostetler, P.O. Box 1967-34274, Nokomis, FL (US) 34274

( * ) Notice: Subject to any disclaimer, the term of this patent is extended or adjusted under 35 U.S.C. 154(b) by 0 days.

(21) Appl. No.: 10/960,686

(22) Filed: Oct. 8, 2004

(51) Int. Cl.
*A47G 1/17* (2006.01)

(52) U.S. Cl. ..... 248/309.3; 211/75; 248/205.9; 248/206.3

(58) Field of Classification Search ..... 248/309.3, 248/205.7, 205.8, 205.9, 206.3, 68.1, 154, 248/363; 211/75
See application file for complete search history.

(56) References Cited

U.S. PATENT DOCUMENTS 2,634,077 A * 4/1953 Van Dusen ..... 248/205.8
3,643,813 A * 2/1972 Noonan ..... 211/75
3,986,695 A * 10/1976 Hronas ..... 248/222.51
5,435,511 A * 7/1995 Hsu ..... 248/206.3
5,533,701 A * 7/1996 Trank ..... 248/316.4
5,715,876 A * 2/1998 Burt ..... 141/86
6,308,923 B1 * 10/2001 Howard ..... 248/205.5
6,588,775 B1 * 7/2003 Malone, Jr. ..... 280/47.18

* cited by examiner

*Primary Examiner*—Ramon O Ramirez
(74) *Attorney, Agent, or Firm*—Buchanan Ingersoll PC

(57) ABSTRACT

A portable gas tank holder for securing cylindrical compressed gas tanks to a support surface, such as a boat hull. The holder includes a frame having at least one gas tank-receiving pocket. At least two suction cups are attached to the frame for securing the frame to the surface. A manually operable suction release valve is provided for each suction cup which can be actuated by a user who is holding the frame.

3 Claims, 9 Drawing Sheets

PORTABLE HOLDER FOR GAS CYLINDERS

BACKGROUND OF THE INVENTION

The present invention relates to a holder for securing in place portable cylindrical compressed gas tanks, such as the type used in medical or scuba diving applications for example.

Scuba divers, as they are being transported to a dive site (usually by boat) typically do not wear their air tanks, as they are heavy and cumbersome out of water. It is undesirable for the tanks to be able to roll around on the boat's deck, as they can become damaged and pose a hazard. For that reason, some boats are equipped with scuba tank holders affixed to the boat hull, which can safely secure the scuba tanks in place (e.g., see U.S. Pat. No. 5,533,701). However, since not all boats are so equipped, a diver cannot always be confident that his or her tanks will be safely secured during transport to a dive site.

Moreover, known scuba tank holders are typically secured to a boat hull by means of screws or bolts disposed in holes formed in the hull. The forming of holes in a boat hull is generally undesirable for aesthetic reasons, and it may be impractical to do so in the case of single-wall hulls, since the holes could result in water leakage.

Therefore, it would be desirable for a scuba diver to be able to safely secure scuba tanks in a boat regardless of whether the boat comes equipped with a tank holder.

It would also be desirable to enable any facility, such as a hospital, to be able to permanently or temporarily secure gas tanks at desired locations.

SUMMARY OF INVENTION

Those objects have been achieved by the present invention which relates to a portable gas tank holder for securing at least one cylindrical compressed gas tank to a surface (such as a boat hull for example). The holder includes a frame having at least one gas tank-receiving pocket, and at least two suction cups attached to the frame for removably securing the frame to the surface. Each suction cup has connected thereto a manually actuable suction release value.

DESCRIPTION OF THE DRAWINGS

The objects and advantages of the invention will become apparent from the following detailed description of a preferred embodiment thereof in connection with the accompanying drawings in which like numerals designate like elements, and in which.

DESCRIPTION OF PREFERRED EMBODIMENTS OF THE INVENTION

Figure 4:
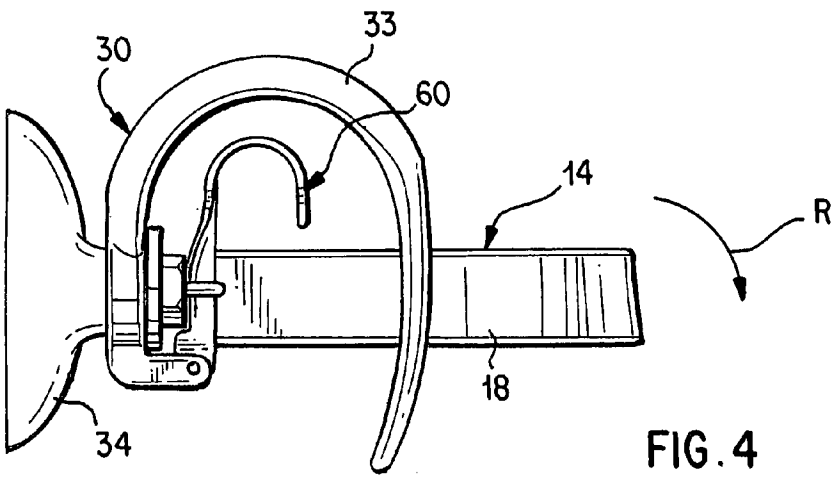
FIG. 4 is an end view of FIG. 1.
Figure 5:
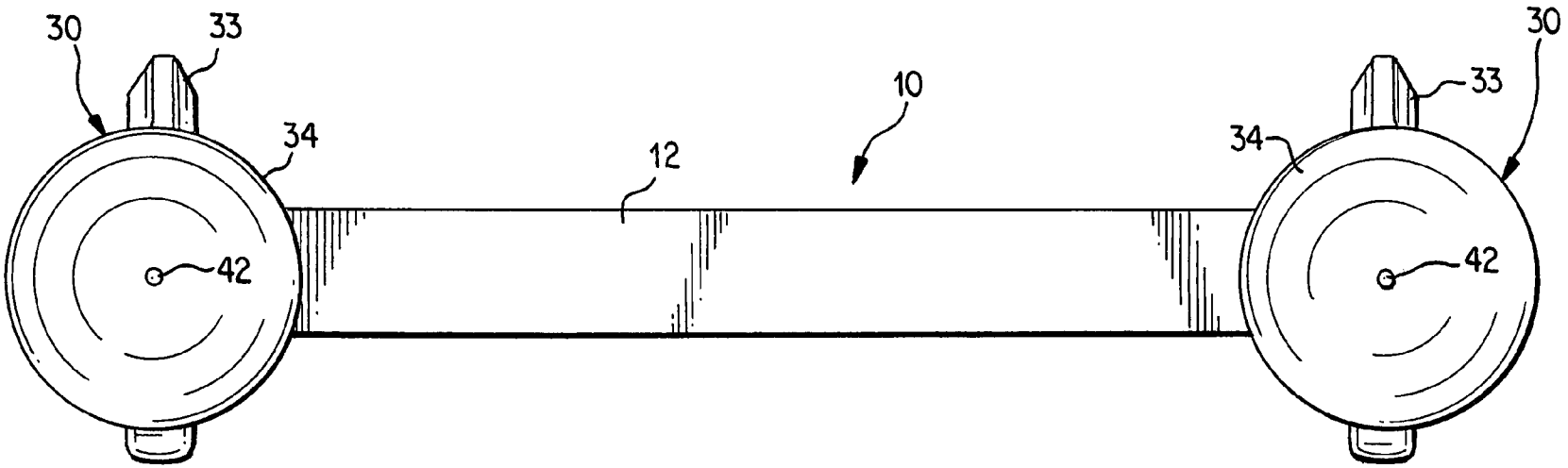
FIG. 5 is a front side elevational view of FIG. 1.

A portable gas-tank holder 10 comprises a rigid rail 12 in which at least one bracket 14 is mounted. Each bracket 14 includes a base 16 that is slidable in the rail, and a pair of arms 18 pivotably mounted to the base for individual rotation in a direction R (FIG. 4) about an axis 20 oriented parallel to the rail to enable the arms to be swung downwardly to a retracted vertical position for more convenient storage of the holder, or an extended horizontal position in which the pair of arms cooperate with the base to form a generally semi-circular tank-receiving pocket 22, as shown in the figures. Such a rail/bracket assembly is known, but the known assembly has been mounted to a support surface, e.g., a boat hull, by bolts passing through holes formed in the boat hull.

Figure 1:
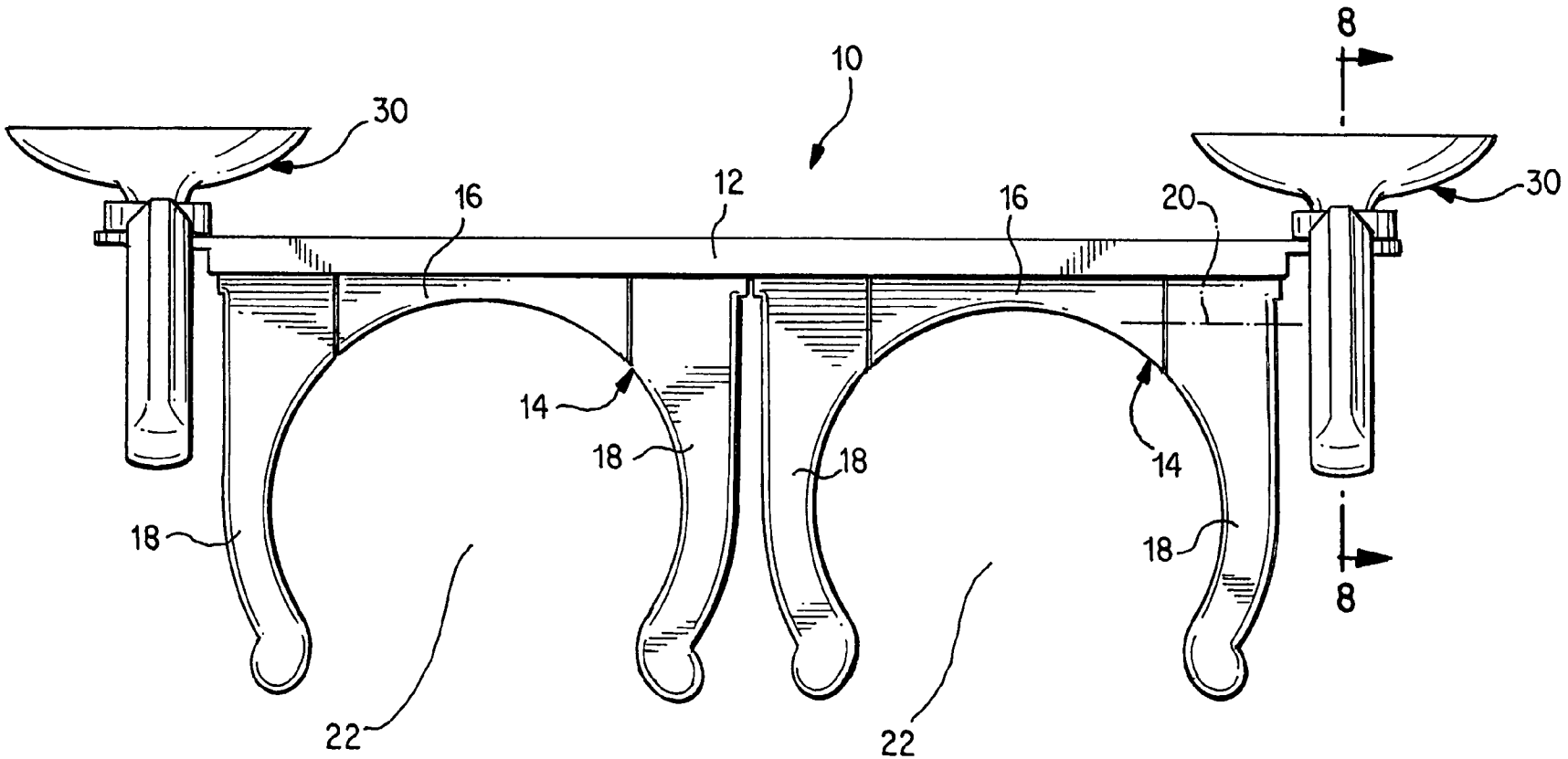
FIG. 1 is a top plan view of a tank holder according to the invention, with the tank-supporting arms in a horizontally extended position, and with no tanks being supported by the holder.
Figure 3:
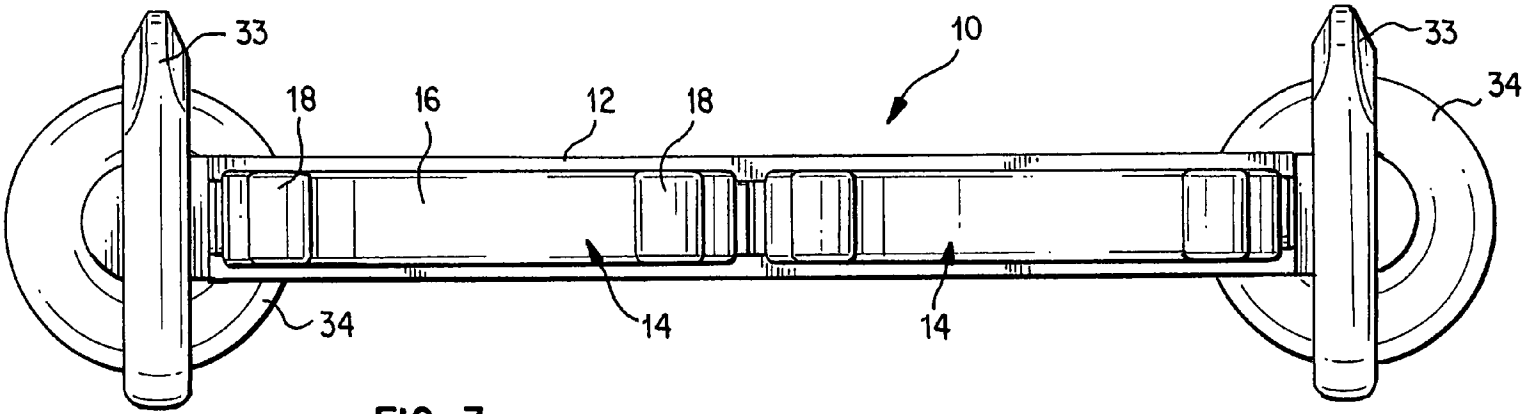
FIG. 3 is a rear side elevational view of FIG. 1.
Figure 8:
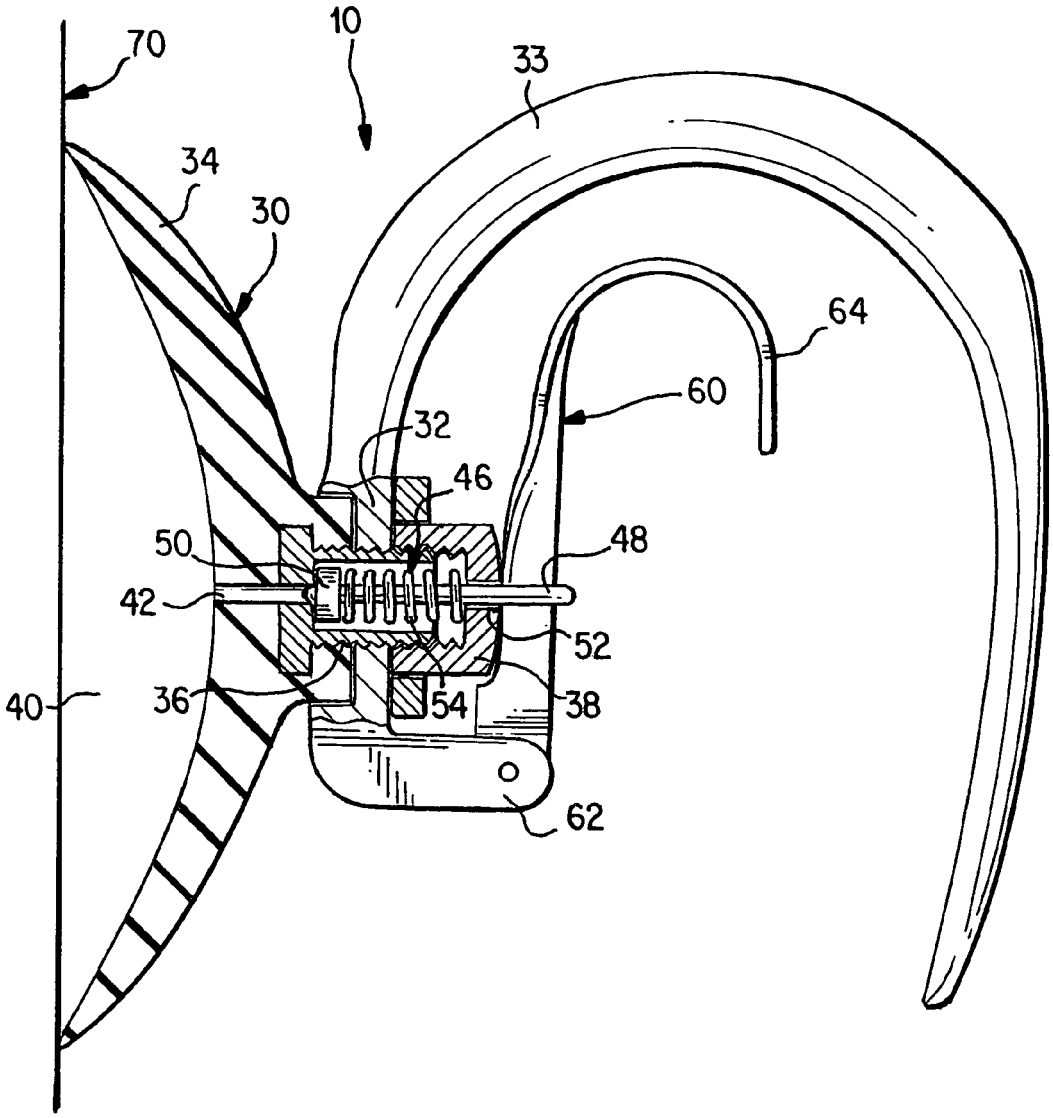
FIG. 8 is a sectional view taken along the line 8—8 in FIG. 1 with the holder not supported on a wall surface, and with a suction-release valve in a closed state.

The need to form holes in the support surface is avoided by the present invention which utilizes suction cup assemblies 30 that are known per se. Two identical suction cup assemblies 30 are provided at respective ends of the rail. Each suction cup assembly comprises a rigid base 32 (see FIG. 8) having a through-hole formed therein, and a curved handle 33 extending rearwardly from the base, such that the handle 33 is situated on the same side of the rail 12 as the brackets 14 (see FIG. 4). From FIGS. 1 and 3 it will be appreciated that the rear portions of respective handles 33 are in non-interconnected relationship.

Attached to a front side of the base 32 is a suction cup 34 which is formed of an elastomeric material and has an externally threaded shank 36 extending rearwardly from a center thereof. The shank 36 extends through a hole formed through the rail and is secured to the rail by an internally threaded nut 38.

Figure 2:
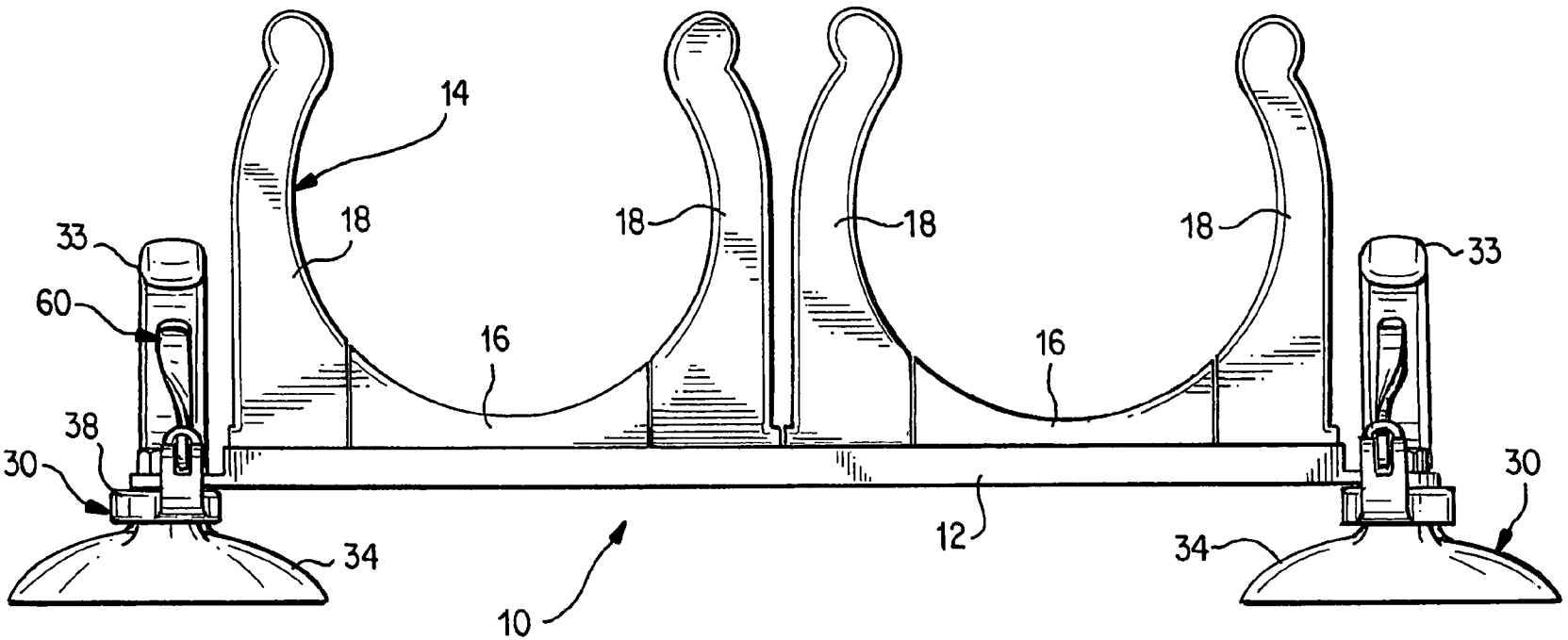
FIG. 2 is a bottom plan view of FIG. 1.
Figure 6:
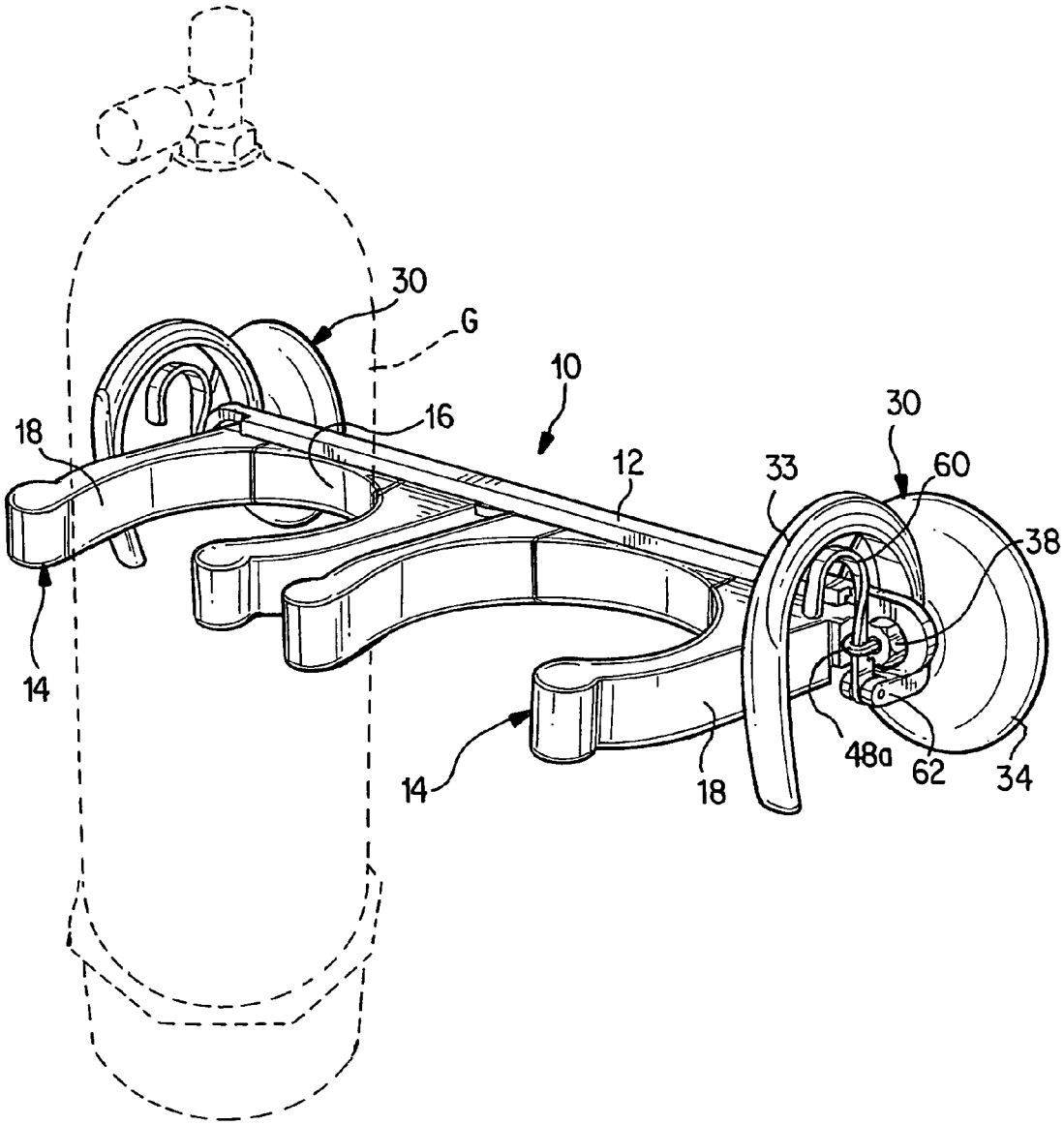
FIG. 6 is a top rear perspective view of FIG. 1, with a gas tank shown in broken lines.
Figure 10:
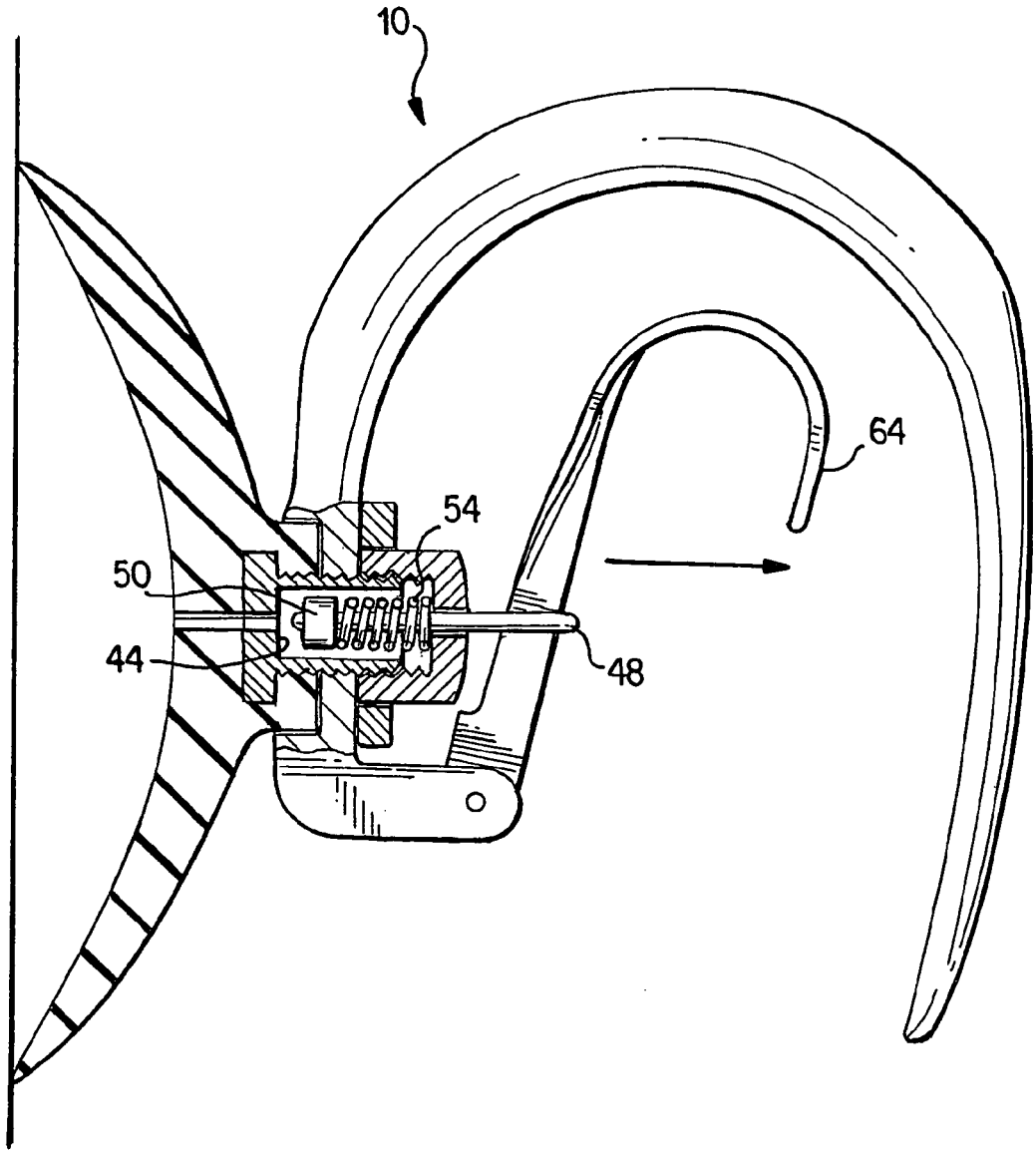
FIG. 10 is a view similar to FIG. 8 showing the suction-release valve in an open state.

The shank 36 is hollow and the interior of the shank communicates with a suction recess 40 formed by the front face of the cup 34 via a port 42 that is surrounded by a seat 44 (see FIG. 10). Slidably mounted within the shank is a valve 46 having a stem 48 and a flexible head 50. The stem extends through the nut and exits rearwardly therefrom via a port 52 formed in the nut. The rear end 48*a* of the valve stem is hook-shaped (see FIGS. 2 and 6) for reasons to be discussed.

The valve 46 is biased forwardly by a coil spring 54 which acts between the nut and the head 50, whereby the head is yieldably biased against the seat 44.

The hook-shaped rear end of the stem 48 receives an actuator 60 which is pivotably mounted between a pair of ears 62 that extend rearwardly from a lower end of the base 32. The actuator 60 includes a curved upper end 64 to define a finger grip.

It will be appreciated that the actuator 60 is situated between the handle and the suction cup and can be griped by a finger (or fingers) of a user while the user is grasping the holder 10 by the handles 33. From FIG. 2 it will be appreciated that the actuators 60 are in non-interconnected relationship and thus separately actuable.

Alternatively, in lieu of a curved actuator 60, there could instead be provided a knob attached to an end of the stem 48, e.g., the knob could be threaded onto the stem.

Figure 9:
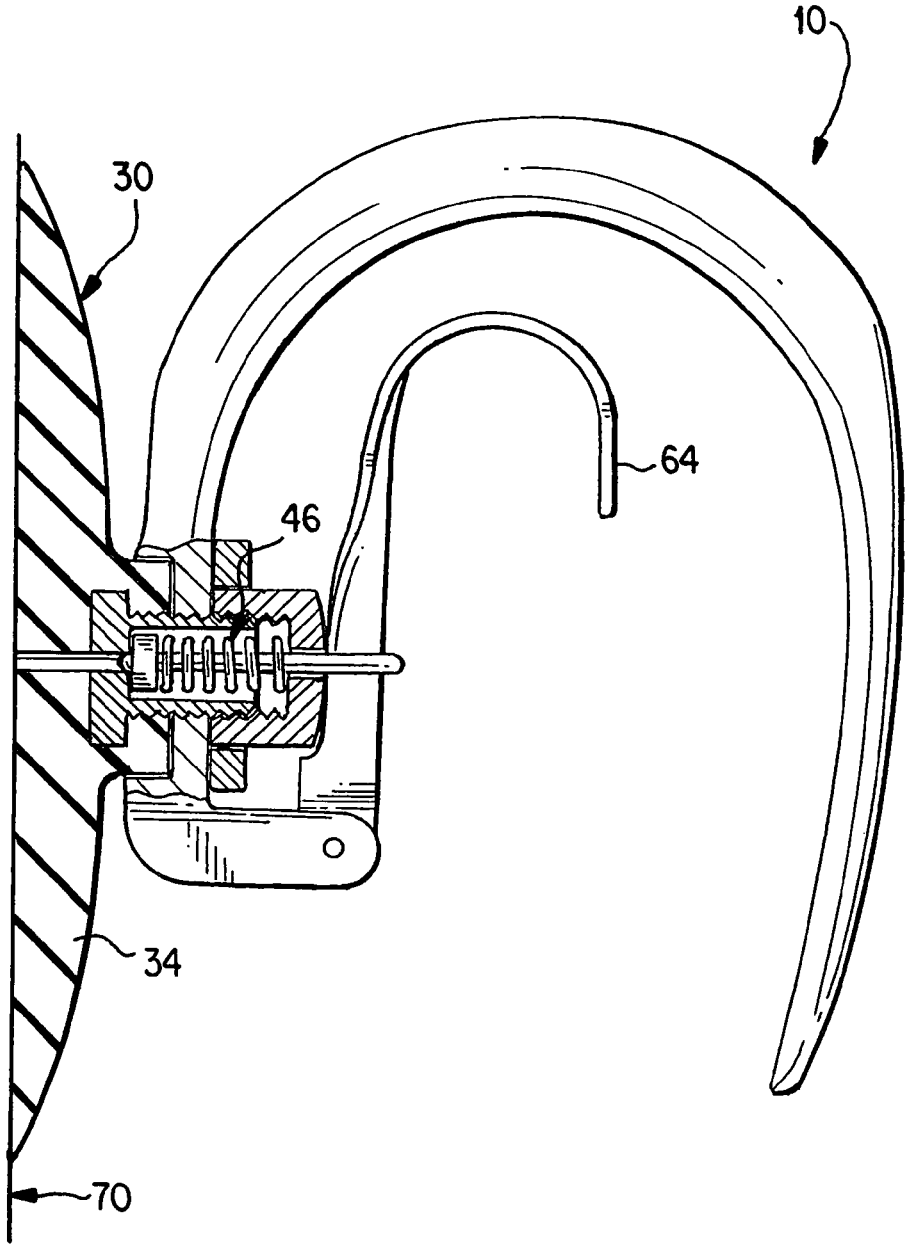
FIG. 9 is a view similar to FIG. 8, with the suction cup secured to a wall surface.

In order to utilize the gas tank holder 10, e.g., on a boat, a user carries the relatively right-weight holder on board and, while grasping the handles 33 in his/her hands presses the suction cups 34 against a support surface 70 while using his/her fingers to manipulate the value actuators 60 in order to pull the valve head 50 away from the seat 44 (see FIG. 10). That opens the recess 40 of each suction cup to atmosphere via the shank 36 and the port 52 of the nut, so that air can be evacuated from the recess. Then, upon release of the actuators 60, the springs 54 push the valve heads 50 against the respective valve seats 44 to close off the suction cup recesses. The trapped suction in the recesses secures the holder to the support surface, as shown in FIG. 9.

Gas tanks G can then be inserted into the pockets 22 formed by the brackets 14. Preferably, the holder is positioned close enough to a floor F to enable the bottoms of the tanks to rest on the floor.

It will be appreciated that the gas tanks are now secured against movement by the holder 10.

In order to remove the holder 10 from the support surface 70 (after the tanks G have been removed), it is merely necessary for the user to grasp the handles 33 and manipulate the manual actuators 60 to pull the valve heads 50 away from the valve seats 44, whereby the suction in the suction recesses 40 is released (see FIG. 10).

The portable holder is especially beneficial to scuba divers who can use the holder on a boat that does not come equipped with adequate means for securing gas tanks. There is no need to form unsightly holes in the boat hull or to risk any water leakage that might result from such holes.

The portable holder 10 can also be used in any type of facility that uses gas tanks, such as hospitals and welding shops for example, in order to provide a temporary tank-holding ability anywhere at the facility. The holder cold also be temporarily attached to the sidewall of a pick-up truck bed during transport of gas tanks.

Figure 7:
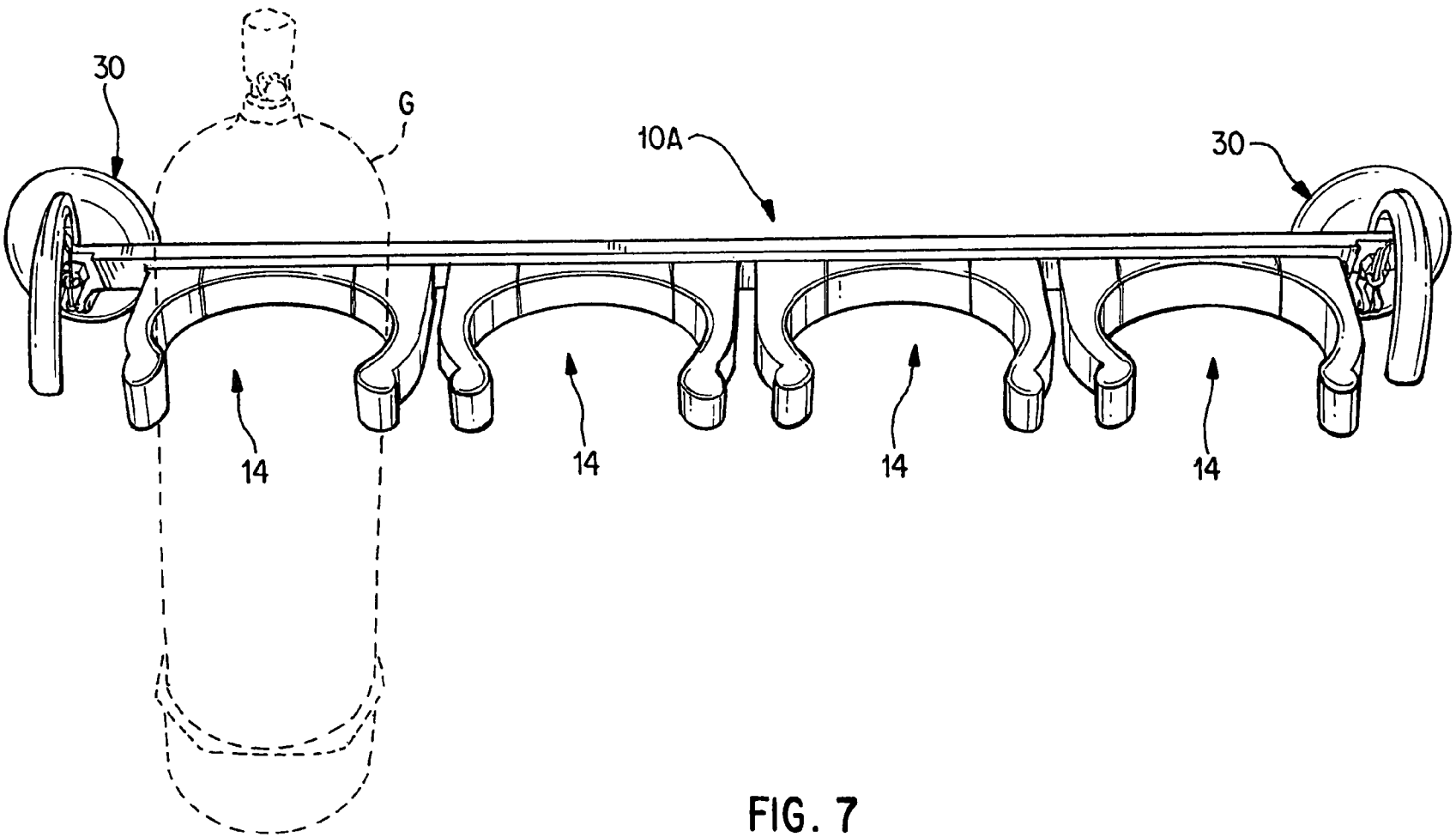
FIG. 7 is a top rear perspective view of a second embodiment of the invention having four tank-supporting brackets, the difference from the first embodiment relating to the number of cylinder-supporting brackets.

Any suitable number of tank-holding brackets 14 could be used, although one to four of such brackets are preferably employed. See FIG. 7 showing a holder 10A having four brackets 14. The tank-receiving pocket(s) 22 need not be formed by brackets 14. Instead, the pocket(s) could be formed by any suitable structure.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

The invention claimed is:

1. A portable gas tank holder for securing at least one cylindrical compressed gas tank to a support surface, comprising:

a frame having at least one gas tank-receiving pocket, at least two suction cups attached to the frame for removably securing the frame to the surface, and each suction cup having connected thereto a manually actuable suction release valve which includes a manually movable actuator, the manually movable actuators being in non-interconnected relationship and separately actuable, and first and second gripping handles mounted adjacent respective ends of the support member, the handles extending rearwardly of the support member and including respective rear end portions disposed remotely of the respective suction cups, the rear end portions of the handles being in non-interconnected relationship.

2. The portable gas tank holder according to claim 1 wherein the frame includes a rigid support member on which the at least one gas tank-receiving pocket is disposed, the rigid support member having opposite first and second ends, the at least two suction cups including first and second suction cups mounted at the first and second ends, respectively.

3. The portable gas tank holder according to claim 2 wherein the rigid member comprises a rail in which at least one bracket is mounted, the at least one bracket defining the at least one tank-receiving pocket.

* * * * *